United States Patent [19]

Smith

[11] Patent Number: 4,619,304

[45] Date of Patent: Oct. 28, 1986

[54] HINGES

[75] Inventor: Michael T. Smith, Swanley, England

[73] Assignee: Courier Display Systems Limited, London, England

[21] Appl. No.: 442,307

[22] Filed: Nov. 17, 1982

[30] Foreign Application Priority Data

Feb. 15, 1982 [GB] United Kingdom ..... 8204362
Oct. 28, 1982 [GB] United Kingdom ..... 8230870

[51] Int. Cl.[4] ..... E05D 1/00; G09F 15/00
[52] U.S. Cl. ..... 160/135; 16/226
[58] Field of Search ..... 160/135, 351, 229 R; 16/225, 226, 227, 373; 211/74, 77, 60 S, 199; 206/142; 220/339, 94 R

[56] References Cited

U.S. PATENT DOCUMENTS

| | | | |
|---|---|---|---|
| 2,891,664 | 6/1959 | Goyert | 206/142 |
| 3,501,800 | 3/1970 | O'Dea | 16/227 |
| 3,913,598 | 10/1975 | Glutting, Jr. et al. | 160/229 R |
| 4,063,585 | 12/1977 | Stanley | 160/229 R |
| 4,134,439 | 1/1979 | Scott | 160/135 |

FOREIGN PATENT DOCUMENTS

| | | | |
|---|---|---|---|
| 1030268 | 6/1953 | France | 16/225 |
| 1267189 | 3/1972 | United Kingdom . | |
| 2069212 | 8/1981 | United Kingdom | 160/135 |

*Primary Examiner*—Ramon S. Britts
*Assistant Examiner*—Cherney S. Lieberman
*Attorney, Agent, or Firm*—Kane, Dalsimer, Kane, Sullivan and Kurucz

[57] ABSTRACT

A hinged structure comprising two substantially cylindrical supports (13, 14) and one or more hinges (11, 12) hinging the supports together so that they are parallel and closely adjacent, wherein the hinge comprises two members (1, 2) each made of resiliently flexible strip material, each member being S-shaped, passing partially round each support and together with the other member forming a letter script letter X or figure 8 configuration as seen in a direction along the supports, respective means (5, 6; 9, 10) being provided fastening together the ends of the members alongside each support so that the members are tensioned round the supports.

21 Claims, 8 Drawing Figures

HINGES

The present invention relates to hinges and especially to hinges for use in portable display systems.

The present invention provides a hinged structure comprising two substantially cylindrical supports and one or more hinges hinging the supports together so that they are parallel and closely adjacent, wherein the or each hinge comprises two members each made of resiliently flexible strip material, each member being S-shaped, passing partially round each support and together with the other member forming a script letter X or figure 8 configuration as seen in a direction along the supports, respective means being provided fastening together the ends of the members alongside each support so that the members are tensioned round the supports.

The present invention also provides a hinged structure comprising three or more substantially cylindrical supports and one or more hinges hinging the supports together so that they are parallel and so that respective pairs of supports are closely adjacent, wherein the or each hinge comprises two members each made of resiliently flexible strip material, each member being of sinuous form, passing partially round each support and together with the other member forming a script letter X or figure 8 configuration around each pair of adjacent supports as seen in a direction along those supports, respective means being provided fastening together the ends of the members alongside each end support so that the members are tensioned round the supports.

Although the or each hinge may comprise just the two strip members especially when used in conjunction with one or more identical hinges it is preferred if the hinge comprises at least three S-shaped or sinuous members, two of the members being of the same hand and one or more of the other members being of opposite hand and mounted between those two, each of the outer members of one hand forming the said script letter X or figure 8 configuration with the or each of the members of the other hand as seen in a direction along the supports.

In a modification of the structure having a hinge comprising three or more strip members, the hinge is of generally Y- or tuning fork-like form when flat, each of the two arms of the hinge constituting the outer members of the aforesaid structure and the upright of the hinge constituting the inner member(s) of that structure, the ends of the arms and the upright terminating alongside one of the supports where they are fastened together by means tensioning the arms and upright round the supports.

The supports must not have any sharp edges which could damage the hinge members, but, subject to that the supports can be of virtually any, preferably rounded, form in cross-section; for example the supports can be D-shaped in cross-section with rounded corner edges. It is preferred, however, if each support is a substantially right-circular cylinder.

The diameters of the supports can, where necessary, be of a different diameter but it is preferred if their diameters are substantially the same.

Many different fastening/tensioning means can be used but it is preferred if those means comprise a pair of plates to which the ends of the members are attached and clamping means for clamping the plates together. The fastening means can, for example, comprise screws and nuts or a clamping strip to clamp the plates in position.

Advantageously, one or more of the supports has a recessed portion into which the or respective ends of the hinge members are pressed by the fastening means.

In that case, the fastening means may comprise a screw which passes through the ends of the hinge members and into the wall of the recessed portion of the support.

Each of the strips can be made from various materials as long as it is resiliently flexible and is sufficiently robust in use. Thus many plastics and/or fibrous materials and/or metal materials may be used but it is preferred if each strip is made of sprung steel or tempered steel.

Preferably, each hinge member is flat rather than S-shaped or sinuous prior to mounting on the supports. This allows the supports freely to be brought into, and to be self-maintained in any angular position relative to each other (as required, for example, in display systems). If, however, one requires a self-returning hinge mechanism (allowing the supports to be angularly displaced from, and automatically to return to a given relative position) the hinge members can be pre-shaped from sprung material for that purpose before mounting on the supports.

The present invention further provides a display system comprising a hinged structure according to the invention.

Each of the supports may form part of a rectangular framework for supporting display panels.

Preferably, each framework supports a pair of panels which are arranged in face-to-face relationship and have a gap between them. In this way it is possible to arrange the fastening means (such as the plates) within the gap so that they are hidden from view.

Preferably, the display system further includes edging or capping strip members which are arranged along those parts of the framework lying at right angles to the supports, the edging members serving to hold the aforesaid panels arranged in face-to-face relationship to the framework.

Advantageously, each edging strip is in the form of a channel-shaped member which is fastened to the framework so that its edge members hold respective panels in position. In this way removal of the edging strip enables each panel to be removed from the framework in a direction at right angles to the plane of that panel.

Preferably, the edging members have raised or recessed portions which are complementary in cross-section whereby two similar frameworks can be stacked one on the other in male-female arrangement. In this way, the frameworks can be suitably located one relative to the other and the supports of each framework may be joined together by suitable end connectors (for example, tubular in form) to provide a rigid connection between the frameworks.

Preferably, those parts of the framework lying at right angles to the supports are of channel-shaped form and are arranged to receive and clamp together the end portions of the said plates.

Hinge structures and a display system incorporating one of these structures, the structures and the display system being constructed in accordance with the invention, will now be described, by way of example, with reference to the accompanying drawings in which.

Figure 1:
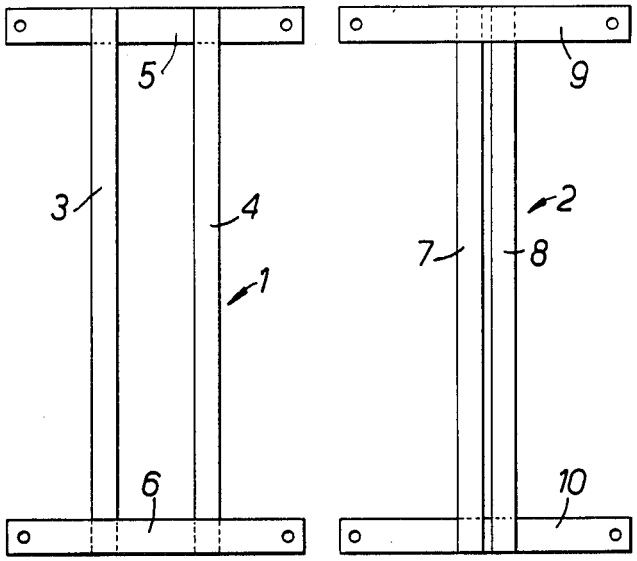
FIG. 1 is a plan view of two hinge members for forming a hinge.
Figure 4:
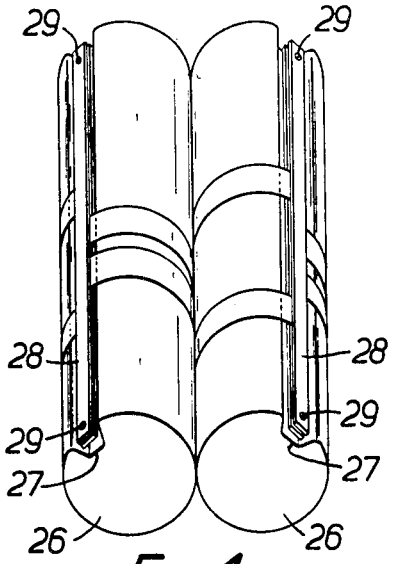
Figure 5:
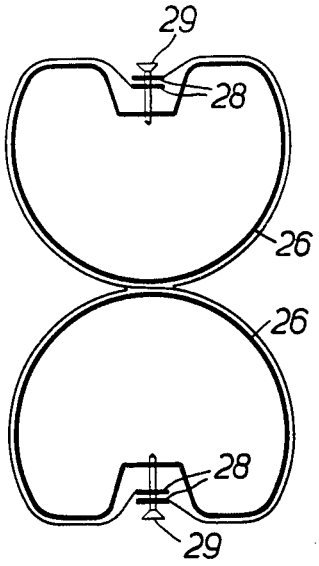
Figure 6:
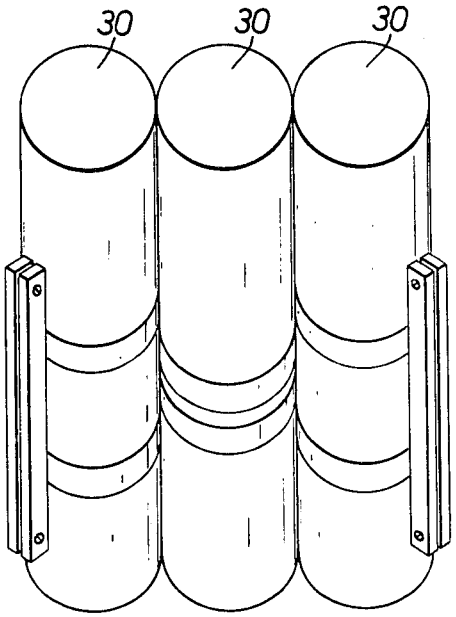
Figure 7:
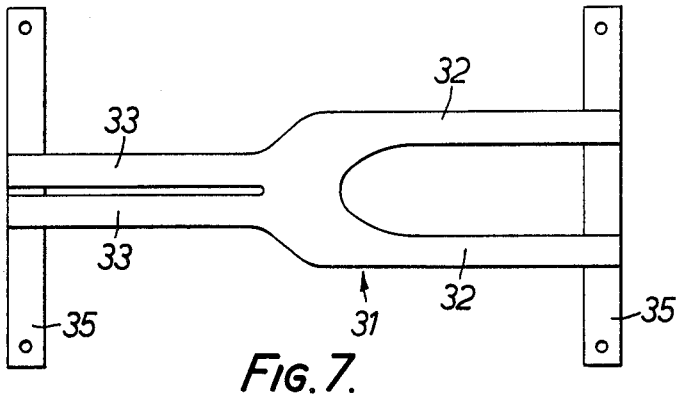
Figure 8:
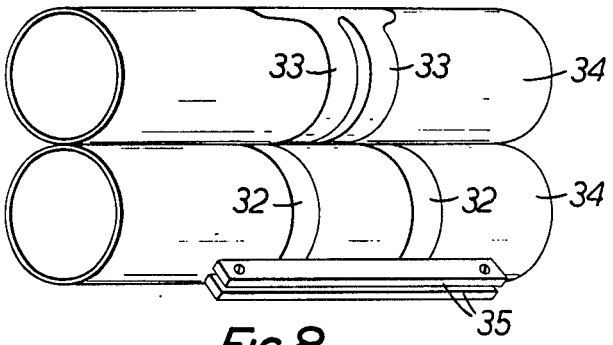

FIG. 4 is a perspective view of a modified hinged structure incorporating the hinge members shown in FIG. 1, FIG. 5 is an end view of a modified hinged structure incorporating the hinge members shown in FIG. 1, FIG. 6 is a perspective view of another hinged structure incorporating hinge members of the type shown in FIG. 1, with longer straps, FIG. 7 is a plan view of a modified hinge member, and FIG. 8 is a perspective view of a hinged structure incorporating a hinge member of the type shown in FIG. 7.

Referring to the accompanying drawing and first of all to FIG. 1 the hinge comprises two hinge members indicated generally at 1 and 2. The hinge member 1 comprises two parallel strips 3 and 4 each made of resiliently flexible strip material, preferably sprung stainless steel. Each of the strips 3 and 4 is flat and its ends are secured to two fastening plates 5 and 6, for example by welding. As will be seen from FIG. 1 each of the strips 3 and 4 is secured to the upper surface of the plate 5 and to the lower surface of the plate 6.

Similarly the hinge member 2 comprises two parallel flat strips 7 and 8, which are made from the same material as the strips 3 and 4 the ends of which are secured to fastening plates 9 and 10. As shown in FIG. 1 the strip members 7 and 8 are secured to the under-side of the plate 9 and to the upper-side of plate 10.

Figure 2:
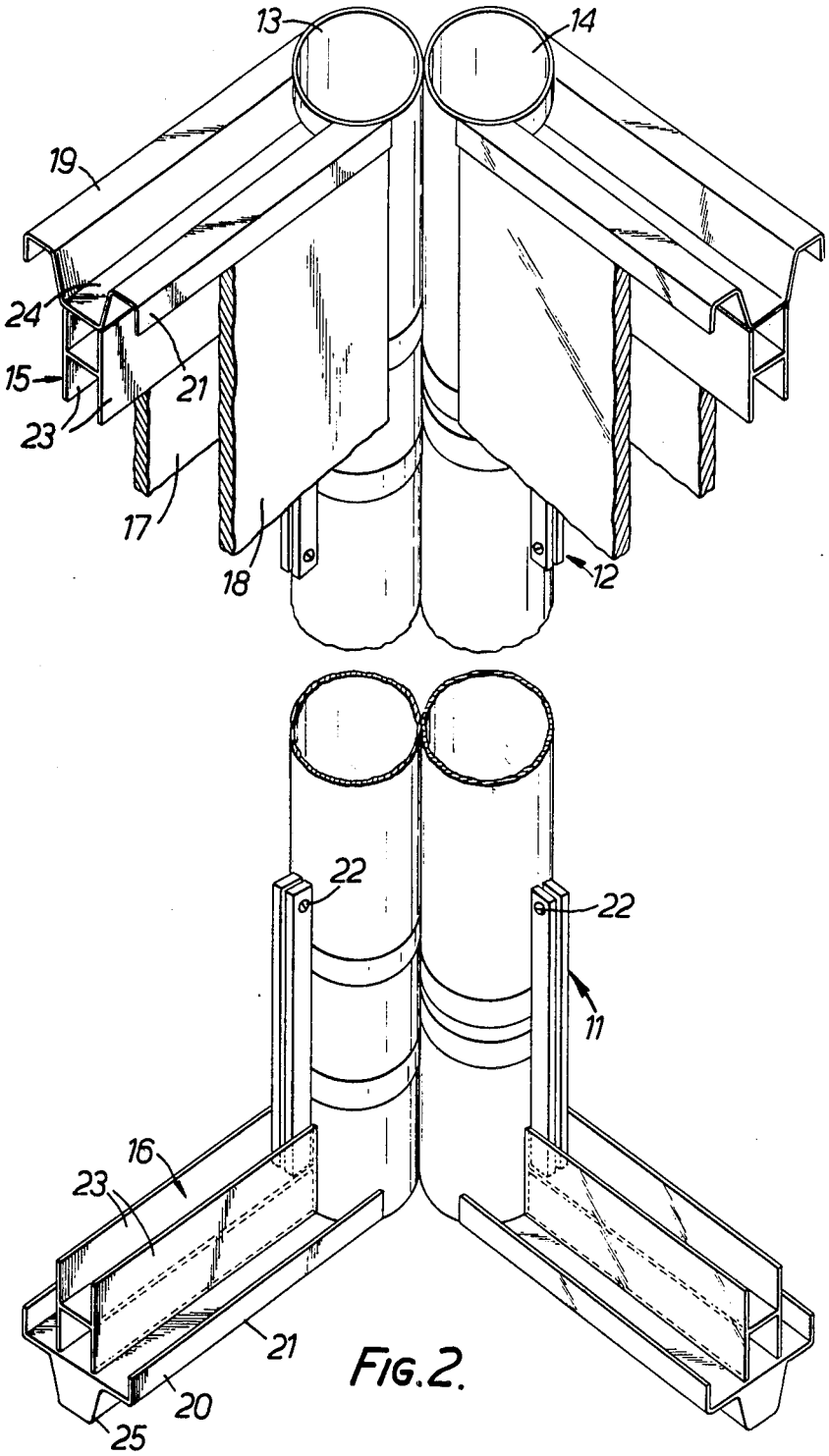
FIG. 2 is a perspective view of a part of a display system incorporating hinge members of the type shown in FIG. 1, FIG. 3 diagramatically shows the formation of the hinge members when used in the display system of FIG. 2 with the support members omitted.

FIG. 2 illustrates part of a display system incorporating hinge members as shown in FIG. 1. FIG. 2 actually illustrates two hinges each using the hinge members of FIG. 1 and FIG. 3 diagramatically illustrates the configuration of the hinge members of one of those hinges when used in the display system of FIG. 2, the support members being omitted from FIG. 3 in order more clearly to illustrate that configuration.

Figure 3:
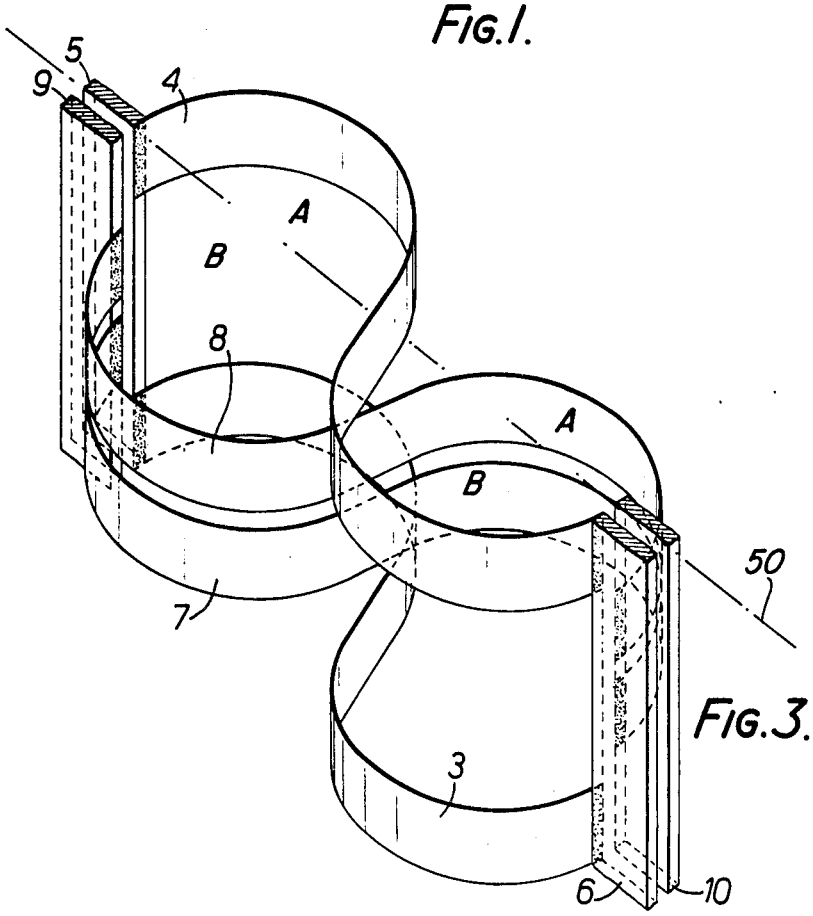

As will be seen from FIG. 3 the plates 5 and 9 and plates 6 and 10 are arranged in face-to-face relationship so that the ends of the strips attached to those plates lie between the plates. It will be evident from FIG. 3 that when the hinge is looked at in plan view each of the strips 3, 4, 7 and 8 is of generally S-shaped form. The strips 3 and 4 are of the same hand and the strips 7 and 8 are of the opposite hand and arranged between the strips 3 and 4. Further it will be evident from FIG. 3 that the strips 3 and 4 form, when looked at in plan view, with the strips 7 and 8 a figure 8-type configuration.

In order to arrange the strip members in the way shown in FIG. 3 it is necessary, first of all, to arrange the strips 7 and 8 between the strips 3 and 4 and parallel to them. This is simply achieved by passing one of the plates 9 or 10 through the gap between the strips 3 and 4 and then suitably arranging the plate 5 opposite the plate 9 and the plate 6 opposite the plate 10. Cylindrical supports 13 and 14 (see FIG. 2) when supported by the strips and plates of FIG. 3, have axes which generate plane 50. First surfaces of cylindrical supports 13 and 14 are located on side A of plane 50, while second surfaces of cylindrical supports 13 and 14 are located on side B of plane 50.

Referring now to FIG. 2 this illustrates, as mentioned previously, part of a display system using two hinges 11 and 12 each of which comprises the hinge members shown in FIGS. 1 and 3. As will be seen from FIG. 2 each of the hinges 11 and 12 has been mounted on two cylindrical supports 13 and 14. The two support members are joined together by the hinges so that they are closely adjacent with their axes parallel.

Each of the hinges can be mounted on the supports by moving the opposed plates 5 and 9, or 6 and 10 apart so that the strip members can be drawn round the support until those plates are arranged in face-to-face relationship. The plates are then fastened together in a way which will be described later.

Referring again to FIG. 2 of the drawings the two support members 13 and 14 form part of a rectangular framework only part of which is shown in that figure. The support 13 (or 14) is secured by two parallel frame members 15 and 16, one at each end of the support 13 (or 14) to another frame member which may be in the form of another cylindrical support. Display panels 17,18 can be secured to the framework by channel shaped capping or edging members 19 and 20 the edges 21 of which clamp the panels against the members 15 and 16 when the edging strips 19 and 20 are secured to the frame members 15 and 16.

As will be evident from FIG. 2 the space between the panels 17 and 18 accommodates the plates 5 and 6, and 9 and 10 of the hinge members so that they are hidden from view.

Further, if, as described later, each of the edging strips 19 and 20 is releasably secured to the frame members 15 and 16 then, when each of those strips is removed, the panels 17 and 18 can be detached from the frame by movement in a direction at right-angles to the plane of those panels.

As will be clear from the lower portion of FIG. 2 the plates 5 and 9, and 6 and 10 are secured at one end by screws 22 and at the other end by means of the frame members 15 or 16. For that purpose each of the frame members 15 and 16 is of channel shaped form (in fact as illustrated both frame members are of H-section) the other end of the confronting plates 5 and 9, or 6 and 10 being clamped together by the parallel faces 23 of the frame members 15 and 16. In this way, fastening of the hinges to the support members 13,14 is facilitated because the confronting plates can be held in the channels (defined by the faces 23) of the frame members 15, 16 and then the other end of those plates joined together by the screws 22. Rivets may be used instead of the screws 22.

Each of the edging members 19 and 20 is secured to the frame members 15 and 16 for example by screws (not shown) which enables the edging members to be removed when replacement of the panels 17 and 18 is required.

It will be further noted from FIG. 2 that the edging member 15 has a longitudinally extending U-shaped channel recess 24 whilst the edging member 20 has a longitudinally extending U-shaped channel projection 25. In this way it is possible to stack two similar display systems one on the other by bringing the U-shaped channels into male-female relationship. Tube connectors (not shown) may be used to join together the vertical supports of two support systems so that those systems are rigidly connected together.

Referring now to FIGS. 4 and 5, these each illustrate methods of mounting the hinge members of the type shown in FIG. 1 onto the support members so that the fastening plates do not protrude outwardly. As shown in both FIGS. 4 and 5 each of the support members 26 is provided with a longitudinally extending recessed portion 27 into which the plates 28 are received and then held in position by screws 29 passing through the plates and into the supports (see in particular FIG. 5). In the FIG. 4 construction the supports 26 are of generally right-circular cylindrical form whilst in FIG. 5 the supports are each of generally D-shape in cross-section.

As described and illustrated above the hinge members shown in FIG. 1 can be used to join together two supports. Such hinge members (as can the hinge member shown in FIG. 7, which will be described later) can be used to hinge together more than two supports and FIG. 6 illustrates three supports 30 which have been hinged together in that way.

More particularly the three supports 30 are arranged side-by-side, with two ends supports having fastening means and the hinge members extend from the fastening means of one end support to the other by passing between each support. Each hinge member starts on a first face of an end support, passes between said end support and the intermediate support, across an opposite face of the intermediate support, and in between said intermediate and opposite support a first face of the other end support, said first faces lying on the same sides of said supports.

FIGS. 7 and 8 illustrate a modified hinge member 31 which requires only two fastening plates. As can be seen from FIG. 7 the hinge member 31 is of generally tuning-fork like construction the two limbs 32 of which are equivalent to the strips 3 and 4 of the hinge member as shown in FIG. 1 and the upright comprising two strips 33 is equivalent to the two strips 7 and 8 of the hinge member shown in FIG. 1. FIG. 8 shows how the hinge members of FIG. 7 can be used to fasten together two cylindrical supports 34 the upright having first been passed through the gap between the two limbs 32 or arms of the member and then the two plates 35 being brought together and fastened (in any of the ways described above), to tension the strips round the support members.

Each of the hinges described above comprises four resiliently flexible strips. In fact, only two strips of opposite hand are absolutely essential although it is preferred to have at least three strips, two of the same hand and one or more other strips being mounted between those two and being of opposite hand to those two.

Although the hinges have been described and illustrated above in connection with a display system it will be appreciated that they have other applications and they can be used wherever a hinged connection is required between two substantially cylindrical support members.

The hinges described and illustrated allow the axis of one support to be turned through more than 180° relative to the axis of the other support or its adjacent support and points on the supports themselves can be turned through more than 360° relative to each other. That movement is smooth, frictionless (consequently no lubricant is required), silent and relatively effortless and is achieved by a hinge which allows the two supports to be brought into close adjacency which is not possible with a conventional double hinge and which is more attractive in appearance than, and is less bulky than the conventional hinge.

I claim:

1. A hinged structure comprising:

first and second cylindrical supports disposed in parallel, and having axes which generate a plane, and respective first and second surfaces disposed on opposite sides of said plane;

at least one hinge having a first and second S-shaped strip made out of a resiliently flexible material, each strip passing partially around each support, said first strip passing along the first surface of the first support, between said two cylinders and along the second surface of said second support said first and second surfaces being outer surfaces, said second strip passing along the second surface of said first support and the first surface of said second support, and said first strip having opposed ends, and said second strip having opposed ends; and at least two independent tensioning means external of and contiguous with said first and second cylindrical supports and being attached to said opposed ends of the strips and mounted on said supports.

2. The hinge structure of claim 1 wherein said one hinge further comprises a third S-shaped strip disposed in parallel with said first strip, said second strip being disposed between said first and third strips.

3. The hinge structure of claim 1 wherein said first and second strips are joined at a line midway along their width, a center point being defined midway along the length of the strips, the strips being spaced at a first distance on one side of said center point and at second distance on the other side of said center point, said first distance being larger than said second distance.

4. The hinge structure of claim 1 wherein said tensioning means comprises two plates and means for joining said plates for clamping said strip ends.

5. A hinged structure comprising:

three or more substantially cylindrical supports disposed in parallel and having axes which generate a plane and having opposed first and second surfaces disposed on opposite sides of said plane;

at least one hinge having first and second sinuous strips made of a resiliently flexible material, said strips passing partially around each support, said first strip passing along alternate outer surfaces of adjacent supports, said second strip passing along the alternate outer surfaces opposite the surfaces passed by said first strip; said strips having opposed ends; and at least two independent tensioning means external of and contiguous with said end cylindrical supports and being attached to said opposed ends of the strips and mounted on said end supports.

6. The hinged structure of claim 5 wherein said one hinge further comprises a third sinuous strip disposed in parallel with said first strip, said second strip being disposed between said first and third strips.

7. A display system comprising:

first and second cylindrical supports disposed in parallel, and having axes which generate a plane, and respective first and second surfaces disposed on opposite sides of said plane;

a first and second hinge, each having first and second S-shaped strips made of a resiliently flexible material, each strip passing partially around each support, and first strip passing along said first surface of said first support, between said supports, and along the second surface of said second support, and said second strip passing along said second surface of said first support between said supports, and said first surface of said second support, said strips having opposed ends;

first and second pair of plates mounted on said first support adjacent each hinge, each pair engaging respective ends of said strip between the corresponding plates, said plates being provided to tension said strips; and first and second channels extending perpendicularly to said supports and being arranged to receive and clamp together the respective end portions of said plates;

said first supports and said channels forming rectangular frameworks for supporting a display panel.

8. A hinged structure as claimed in claim 1, in which the hinge comprises at least three S-shaped members, two of the members being of the same hand and one or more of the other members being of opposite hand and mounted between those two.

9. A hinged structure as claimed in claim 1, in which at least one of the supports is a substantially circular cylinder.

10. A hinged structure as claimed in claim 1, in which the diameters of the supports are the same.

11. A hinged structure as claimed in claim 1, in which the tensioning means comprises a first and second pair of plates to which the ends of the strips are attached and clamping means for clamping the plates together.

12. A hinged structure as claimed in claim 1, in which one of the supports has a recessed portion into which the respective ends of the hinge strips are pressed by the tensioning means.

13. A hinged structure as claimed in claim 12, in which the tensioning means comprises a screw which passes through the ends of the hinge strips and into the wall of the recessed portion of the support.

14. A hinged structure as claimed in claim 1, in which each hinge is made of sprung steel.

15. A hinged structure as claimed in claim 1, in which each hinge strip is flat rather than S-shaped or sinuous prior to mounting on the supports.

16. A display system comprising a hinged structure as claimed in claim 1.

17. A display system as claimed in claim 16, in which each of the supports forms part of a rectangular framework for supporting display panels.

18. A display system as claimed in claim 17, in which each framework supports a pair of panels which are arranged in face-to-face relationship and have a gap between them.

19. A display system as claimed in claim 18, in which the system further includes edging strip members which are arranged along those parts of the framework lying at right-angles to the supports, the edging members serving to hold the aforesaid panels arranged in face-to-face relationship to the framework.

20. A display system as claimed in claim 19, in which each edging strip is in the form of a channel-shaped member which is fastened to the framework so that its edge portions hold respective panels in position.

21. A display system as claimed in claim 19, in which the edging members have contoured portions which are complementary in cross-section whereby two similar frameworks can be stacked one on the other in male-female engagement.

* * * * *